US012674456B2

(12) United States Patent
Mori et al.

(10) Patent No.: US 12,674,456 B2
(45) Date of Patent: Jul. 7, 2026

(54) COMPRESSOR AND REFRIGERATION APPARATUS

(71) Applicant: DAIKIN INDUSTRIES, LTD., Osaka (JP)

(72) Inventors: Akira Mori, Osaka (JP); Yasuhiro Murakami, Osaka (JP); Yasuo Mizushima, Osaka (JP); Takeshi Endo, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 19/033,261

(22) Filed: Jan. 21, 2025

(65) Prior Publication Data

US 2025/0163914 A1 May 22, 2025

Related U.S. Application Data

(63) Continuation of application No. PCT/JP2023/019777, filed on May 26, 2023.

(30) Foreign Application Priority Data

Jul. 25, 2022 (JP) ..... 2022-118140

(51) Int. Cl.
*F04C 18/02* (2006.01)
*F25B 31/02* (2006.01)

(52) U.S. Cl.
CPC ..... *F04C 18/0215* (2013.01); *F25B 31/026* (2013.01); *F04C 2240/30* (2013.01)

(58) Field of Classification Search
CPC ..... F04C 18/0215; F04C 2230/231; F04C 2230/60; F04C 2230/603; F04C 2240/30;
(Continued)

(56) References Cited

U.S. PATENT DOCUMENTS 5,547,355 A * 8/1996 Watanabe ..... F04C 23/008 418/57
5,897,306 A * 4/1999 Beck ..... F04C 27/005 418/57

(Continued)

FOREIGN PATENT DOCUMENTS

JP 2002-242872 A 8/2002
JP 2011-43138 A 3/2011
JP 2017-25762 A 2/2017

OTHER PUBLICATIONS https://www.machiningdoctor.com/calculators/tolerances/; Title: Engineering Fits & Tolerances—Calculator & Charts; Date Published 2025.*

(Continued)

*Primary Examiner* — Jesse S Bogue
(74) *Attorney, Agent, or Firm* — Spencer Fane LLP

(57) ABSTRACT

A compressor includes a casing having a tubular barrel, a fixation target member housed in the casing and fixed to the barrel, and a plurality of welds provided in a circumferential direction of the barrel. The welds connect the barrel and the fixation target member to each other. The fixation target member is a support configured to rotatably support a compression mechanism configured to compress a refrigerant or a drive shaft connected to the compression mechanism. An inner diameter of the barrel and an outer diameter of the fixation target member in a rated operating state of the compressor being in a fit relationship in which a combination of a tolerance class for a hole and a tolerance class for a shaft (hole/shaft) defined in ISO 286 corresponds to H8/f7, F8/h9, H7/f7, F8/h6, H7/g6, or G7/h6.

5 Claims, 6 Drawing Sheets

| FITS (recommended fits) | TOLERANCE CLASSES FOR HOLES /FOR SHAFTS | DIMENSIONAL TOLERANCE RANGES [μm] (CASE OF ϕ145 mm) | |
|---|---|---|---|
| loose running fit | H8/d9、D10/h9 | -405~-145 | |
| free running fit | H8/e8、E9/h9 | -285~-85 | |
| close running fit | H8/f7、F8/h9 | -206~-43 | RATED OPERATING STATE |
| sliding fit - free | H7/f7、F8/h6 | -131~-43 | |
| sliding fit - constrained | H7/g6、G7/h6 | -82~-14 | |
| minimal clearance fit | H8/h9 | -163~0 | |
| locational clearance fit | H7/h6 | -68~0 | |
| locational transition fit | H7/j6 | -54~14 | |
| locational transition fit - interference | H7/n6 | -16~52 | |
| locational interference fit | H7/r6 | 22~90 | ASSEMBLED STATE |
| medium drive fit | H7/s6 | 57~125 | |
| force fit | H8/u8 | 127~253 | |
| extreme force fit | H8/x8 | 217~343 | |

(58) Field of Classification Search
CPC .... F04C 2270/12; F04C 23/008; F04C 29/00; F25B 31/026
See application file for complete search history.

(56) References Cited

U.S. PATENT DOCUMENTS

| | | | | |
|---|---|---|---|---|
| 8,221,096 | B2 * | 7/2012 | Taniwa | H02K 1/185 310/216.136 |
| 2017/0022989 | A1 * | 1/2017 | Duppert | F04C 27/005 |

OTHER PUBLICATIONS

European Search Report of corresponding EP Application No. 23 84 5992.9 dated Jun. 10, 2025.
International Preliminary Report of corresponding PCT Application No. PCT/JP2023/019777 dated Feb. 6, 2025.
International Search Report of corresponding PCT Application No. PCT/JP2023/019777 dated Jul. 18, 2023.

* cited by examiner

FIG.6

| FITS (recommended fits) | TOLERANCE CLASSES FOR HOLES /FOR SHAFTS | DIMENSIONAL TOLERANCE RANGES [μm] (CASE OF ϕ145 mm) | |
|---|---|---|---|
| loose running fit | H8/d9、D10/h9 | -405~-145 | |
| free running fit | H8/e8、E9/h9 | -285~-85 | |
| close running fit | H8/f7、F8/h9 | -206~-43 | RATED OPERATING STATE |
| sliding fit – free | H7/f7、F8/h6 | -131~-43 | |
| sliding fit – constrained | H7/g6、G7/h6 | -82~-14 | |
| minimal clearance fit | H8/h9 | -163~0 | |
| locational clearance fit | H7/h6 | -68~0 | |
| locational transition fit | H7/j6 | -54~14 | |
| locational transition fit – interference | H7/n6 | -16~52 | ASSEMBLED STATE |
| locational interference fit | H7/r6 | 22~90 | |
| medium drive fit | H7/s6 | 57~125 | |
| force fit | H8/u8 | 127~253 | |
| extreme force fit | H8/x8 | 217~343 | |

COMPRESSOR AND REFRIGERATION APPARATUS

CROSS-REFERENCE TO RELATED APPLICATIONS

This is a continuation of International Application No. PCT/JP2023/019777 filed on May 26, 2023, which claims priority under 35 U.S.C. § 119(a) to Patent Application No. 2022-118140, filed in Japan on Jul. 25, 2022, all of which are hereby expressly incorporated by reference into the present application.

BACKGROUND

Technical Field

The present disclosure relates to a compressor and a refrigeration apparatus.

Background Art

Japanese Unexamined Patent Publication No. 2017-25762 discloses a scroll compressor including a casing, a compression mechanism, and a housing that rotatably supports a crankshaft (drive shaft) connected to the compression mechanism. The compression mechanism includes a fixed scroll and a movable scroll (orbiting scroll) that meshes with the fixed scroll. The housing has a pressing portion that is pressed against the casing, and a facing portion that faces the casing with the gap therebetween at a location apart from the pressing portion. In the scroll compressor of Patent Document 1, the facing portion of the housing and the casing are welded together.

SUMMARY

A first aspect is directed to a compressor. The compressor includes: a casing having a tubular barrel; a fixation target member housed in the casing and fixed to the barrel; and a plurality of welds provided in a circumferential direction of the barrel, the welds connecting the barrel and the fixation target member to each other. The fixation target member is a support configured to rotatably support a compression mechanism configured to compress a refrigerant or a drive shaft connected to the compression mechanism. An inner diameter of the barrel and an outer diameter of the fixation target member in a rated operating state of the compressor being in a fit relationship in which a combination of a tolerance class for a hole and a tolerance class for a shaft (hole/shaft) defined in ISO 286 corresponds to H8/f7, F8/h9, H7/f7, F8/h6, H7/g6, or G7/h6.

BRIEF DESCRIPTION OF THE DRAWINGS

FIG. 6 is a table showing the terms indicating the fit relationships, the tolerance classes defined in ISO 286 which correspond to the fit relationships, and the dimensional tolerance ranges corresponding to the respective tolerance classes at a basic size of φ145 mm.

DETAILED DESCRIPTION OF EMBODIMENT(S)

Embodiment

Embodiments of the present disclosure will be described in detail below with reference to the drawings. The present disclosure is not limited to the embodiments shown below, and various changes can be made within the scope without departing from the technical concept of the present disclosure. Each of the drawings is intended to illustrate the present disclosure conceptually, and dimensions, ratios, or numbers may be exaggerated or simplified as necessary for the sake of ease of understanding.

(1) Overview of Refrigeration Apparatus

Figure 1:
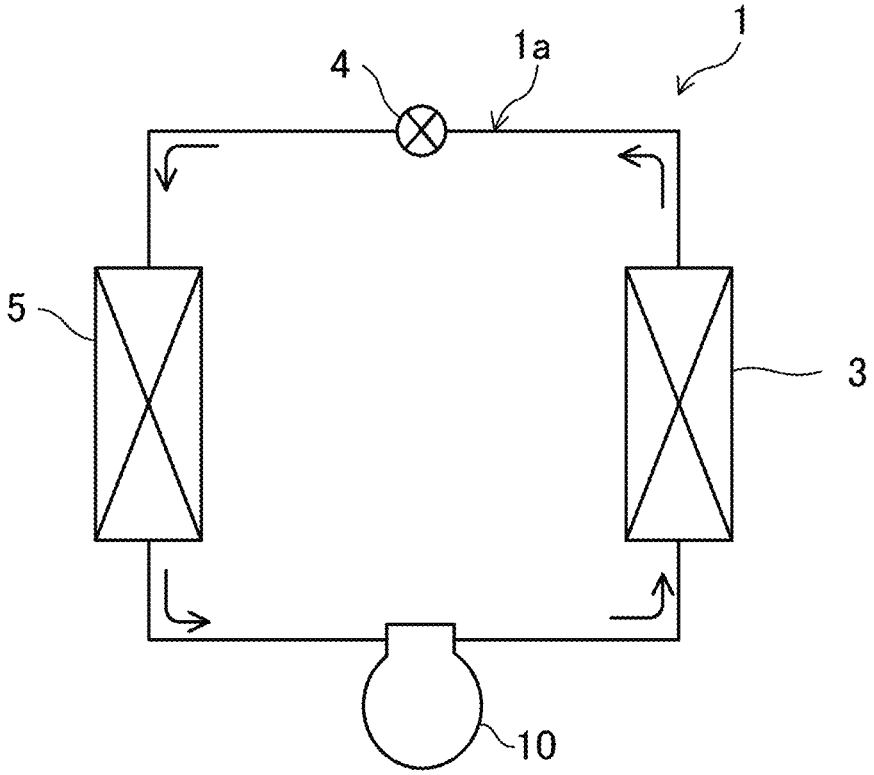
FIG. 1 is a refrigerant circuit diagram showing a configuration of a refrigeration apparatus according to an embodiment.

As illustrated in FIG. 1, a compressor (10) is provided in a refrigeration apparatus (1). The refrigeration apparatus (1) includes a refrigerant circuit (1*a*) filled with a refrigerant. The refrigerant circuit (1*a*) includes the compressor (10), a radiator (3), a decompression mechanism (4), and an evaporator (5). The decompression mechanism (4) is, for example, an expansion valve. The refrigerant circuit (1*a*) performs a vapor compression refrigeration cycle.

The refrigeration apparatus (1) is an air conditioner. The air conditioner may be any of a cooling-only apparatus, a heating-only apparatus, or an air conditioner switchable between cooling and heating. In this case, the air conditioner has a switching mechanism (e.g., a four-way switching valve) configured to switch the direction of circulation of the refrigerant. The refrigeration apparatus (1) may be a water heater, a chiller unit, or a cooling apparatus configured to cool air in an internal space. The cooling apparatus cools air in a refrigerator, a freezer, a container, or the like.

(2) Compressor

Figure 2:
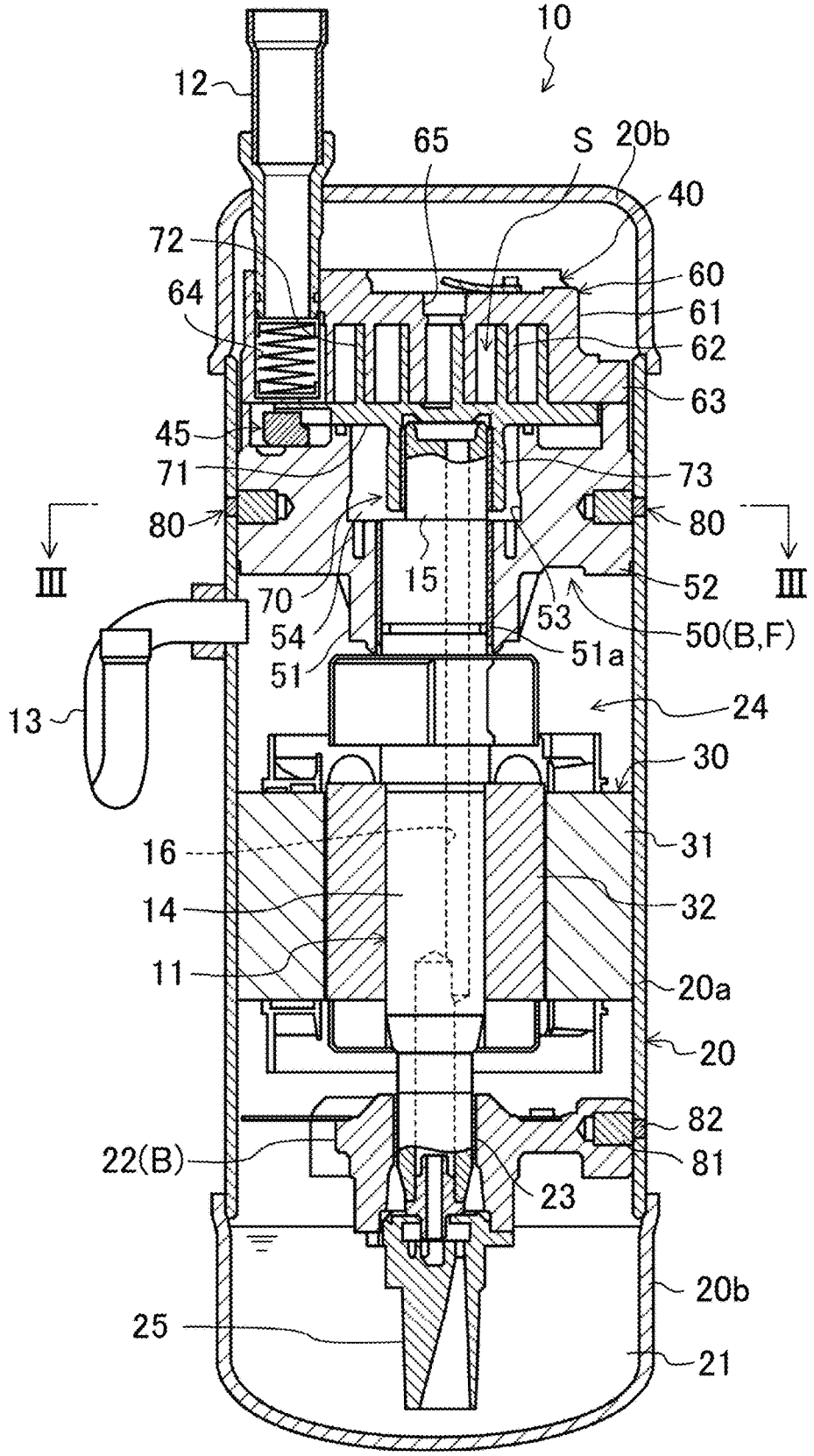
FIG. 2 is a vertical sectional view illustrating a configuration of a scroll compressor.

The compressor (10) of this embodiment is a scroll compressor. As illustrated in FIG. 2, the scroll compressor (10) includes a casing (20), an electric motor (30), a drive shaft (11), and a compression mechanism (40). The electric motor (30), the drive shaft (11), and the compression mechanism (40) are housed in the casing (20).

In the following description, an "axial direction" refers to a direction in which the drive shaft (11) extends, a "radial direction" refers to a direction orthogonal to the axis of the drive shaft (11), and a "circumferential direction" refers to a circumferential direction about the axis of the drive shaft (11). A "radially inner side" is a side closer to the axis of the drive shaft (11), and a "radially outer side" is a side farther from the axis of the drive shaft (11).

(2-1) Casing

The casing (20) is configured as a vertically long closed container. The casing (20) has a cylindrical barrel (20*a*) extending vertically and two lids (20*b*) closing both ends of the barrel (20*a*). When the barrel (20*a*) is viewed in the axial direction, the barrel (20*a*) has a non-perfect circular shape.

The casing (20) has, at its bottom, an oil reservoir (21). The oil reservoir (21) stores a lubricant. A suction pipe (12) is connected to an upper portion of the casing (20). A discharge pipe (13) is connected to the barrel (20*a*) of the casing (20).

(2-2) Electric Motor

The electric motor (30) has a stator (31) and a rotor (32). The stator (31) is fixed to the inner circumferential surface of the casing (20). The rotor (32) is disposed inside the stator (31). The drive shaft (11) passes through the rotor (32). The rotor (32) is fixed to the drive shaft (11).

(2-3) Drive Shaft

The drive shaft (11) extends vertically along the center axis of the casing (20). The drive shaft (11) has a main shaft portion (14) and an eccentric portion (15).

The eccentric portion (15) is provided at an upper end of the main shaft portion (14). The outer diameter of the eccentric portion (15) is smaller than that of the main shaft portion (14). The eccentric portion (15) has an axis decentered by a predetermined distance with respect to the axis of the main shaft portion (14).

The main shaft portion (14) has an upper portion passing through a housing (50) to be described later and rotatably supported by an upper bearing (51) of the housing (50). The main shaft portion (14) has a lower portion rotatably supported by an auxiliary bearing (22) to be described later.

(2-4) Housing

The housing (50) is housed in the casing (20). The housing (50) is a main bearing support that rotatably supports the drive shaft (11). The housing (50) corresponds to a support (B) of the present disclosure, and corresponds to a main bearing housing of the present disclosure.

The housing (50) is disposed below the compression mechanism (40). The housing (50) supports the compression mechanism (40). The housing (50) is located above the electric motor (30). An inflow end of the discharge pipe (13) is located between the housing (50) and the electric motor (30).

The housing (50) has a cylindrical shape extending in the axial direction (vertically). The outer diameter of the housing (50) at an upper portion is larger than the outer diameter of the housing (50) at a lower portion. The inner diameter of the housing (50) at an upper portion is larger than the inner diameter of the housing (50) at a lower portion.

The housing (50) includes an annular portion (52), a recess (53), and an upper bearing (51). The annular portion (52) forms the outer circumference of the housing (50). The annular portion (52) has a non-perfect circular shape when viewed in the axial direction. The recess (53) is formed in the center of the upper portion of the housing (50). The recess (53) has a dish shape recessed downward at the center. The recess (53) forms a crank chamber (54) that houses a boss (73) of an orbiting scroll (70) to be described later.

In the crank chamber (54), the eccentric portion (15) rotates eccentrically. The upper bearing (51) forms a lower portion of the housing (50). Specifically, the upper bearing (51) is formed below the recess (53). A bearing metal (51*a*) is fitted to the inner surface of the upper bearing (51). The upper bearing (51) rotatably supports the main shaft portion (14) of the drive shaft (11) through the bearing metal (51*a*).

Figure 3:
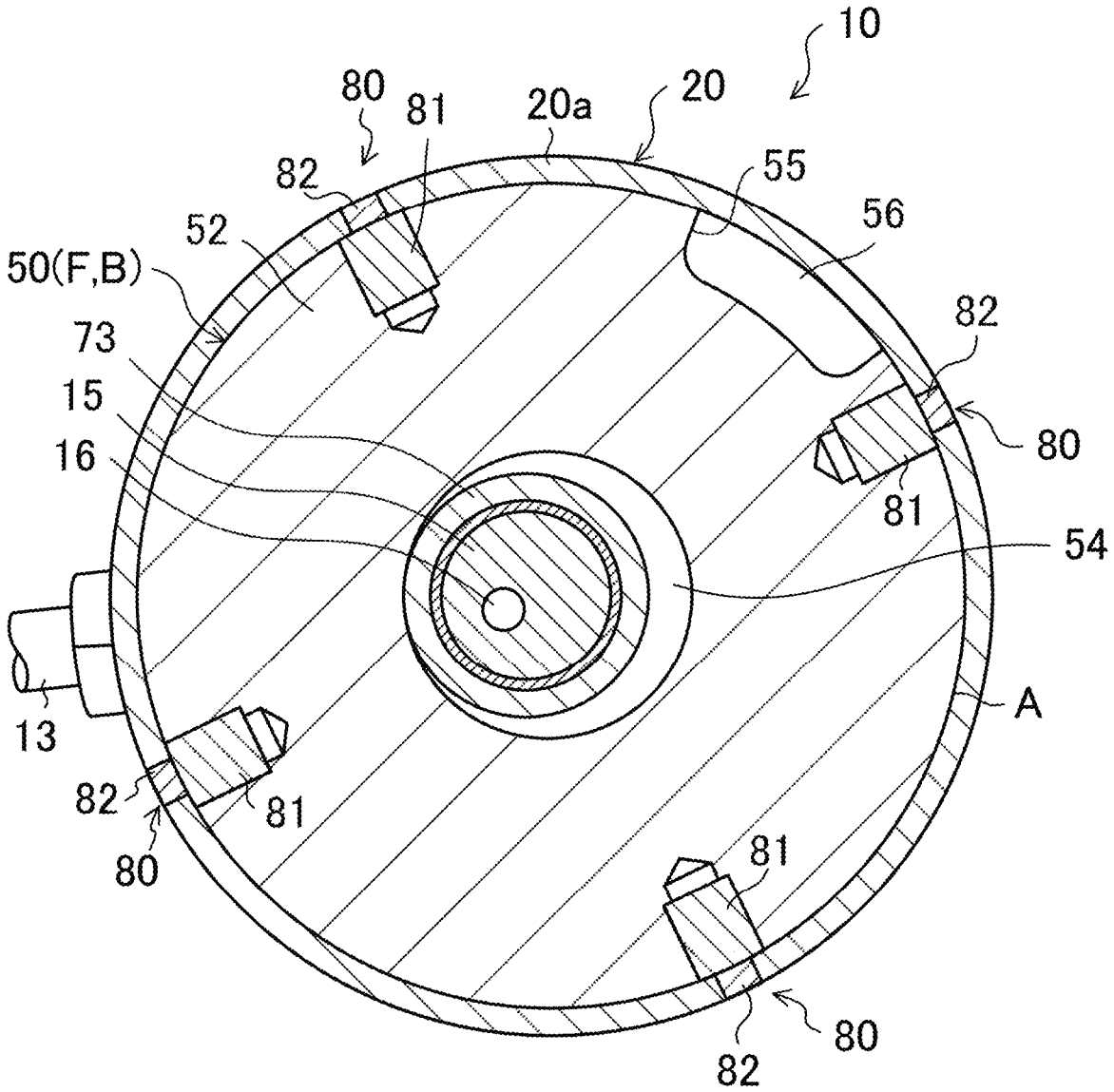
FIG. 3 is a cross-sectional view taken along line III-III shown in FIG. 2 and viewed in the direction of arrows.

As illustrated in FIG. 3, the outer circumferential surface of the annular portion (52) has a cutout (55). The cutout (55) passes vertically through the annular portion (52). The cutout (55) is recessed radially inward. A discharge path (56) through which a gas refrigerant discharged from the compression mechanism (40) passes is formed between the cutout (55) and the inner circumferential surface of the casing (20).

The housing (50) is fixed to the inside of the casing (20). Specifically, the outer circumferential surface of the annular portion (52) of the housing (50) is fixed to the inner circumferential surface of the barrel (20*a*) of the casing (20). A fixing structure of the housing (50) will be described later.

(2-5) Compression Mechanism

The compression mechanism (40) includes a fixed scroll (60) and an orbiting scroll (70). The fixed scroll (60) is fixed to the upper surface of the housing (50). The orbiting scroll (70) is arranged between the fixed scroll (60) and the housing (50).

(2-5-1) Fixed Scroll

The fixed scroll (60) includes a fixed end plate (61), a fixed wrap (62), and an outer circumferential wall (63). The fixed end plate (61) is in the shape of a disk.

The fixed wrap (62) is spiral. The fixed wrap (62) protrudes downward from the front surface (the lower surface in FIG. 2) of the fixed end plate (61). The fixed wrap (62) is disposed on a portion of the fixed end plate (61) inside the outer circumferential wall (63).

The outer circumferential wall (63) is substantially tubular. The outer circumferential wall (63) protrudes downward from the outer edge of the front surface (the lower surface in FIG. 2) of the fixed end plate (61). The outer circumferential wall (63) surrounds the outer periphery of the fixed wrap (62). The distal end surface (the lower surface in FIG. 2) of the fixed wrap (62) and the distal end surface (the lower surface in FIG. 2) of the outer circumferential wall (63) are generally flush with each other.

The outer circumferential wall (63) is located on the outer circumference and is continuous with the fixed wrap (62). The distal end surface of the fixed wrap (62) and the distal end surface of the outer circumferential wall (63) are substantially flush with each other. The fixed scroll (60) is fixed to the housing (50).

(2-5-2) Orbiting Scroll

The orbiting scroll (70) includes an orbiting end plate (71), an orbiting wrap (72), and a boss (73). The orbiting end plate (71) is in the shape of a disk. The orbiting wrap (72) is spiral. The orbiting wrap (72) protrudes upward from the front surface (the upper surface in FIG. 2) of the orbiting end plate (71). The orbiting wrap (72) meshes with the fixed wrap (62).

The boss (73) is formed on a central portion of the back surface (the lower surface in FIG. 2) of the orbiting end plate (71). The eccentric portion (15) of the drive shaft (11) is inserted into the boss (73). Thus, the drive shaft (11) is coupled to the orbiting scroll (70). In other words, the drive shaft (11) is connected to the compression mechanism (40).

(2-5-3) Suction Port, Outlet

The outer circumferential wall (63) of the fixed scroll (60) has a suction port (64). The suction port (64) is open near the winding end of the fixed wrap (62). A downstream end of the suction pipe (12) is connected to the suction port (64).

The fixed end plate (61) of the fixed scroll (60) has, at its center, an outlet (65). The outlet (65) is open to the upper surface of the fixed end plate (61) of the fixed scroll (60). The high-pressure gas refrigerant discharged from the outlet (65) flows out into a lower space (24) under the housing (50) via the discharge path (56) formed in the housing (50).

(2-5-4) Fluid Chamber

The compression mechanism (40) has a fluid chamber(S) into which the refrigerant flows. The fluid chamber(S) is formed between the fixed scroll (60) and the orbiting scroll (70). The orbiting wrap (72) of the orbiting scroll (70) is positioned to mesh with the fixed wrap (62) of the fixed scroll (60). The fixed wrap (62) and the orbiting wrap (72) mesh with each other, thereby compressing the gas refrigerant in the fluid chamber (S).

(2-6) Oldham Coupling

An Oldham coupling (45) is provided at an upper portion of the housing (50). The Oldham coupling (45) is arranged between the housing (50) and the orbiting scroll (70). The Oldham coupling (45) blocks the orbiting scroll (70), which is revolving, from rotating on its own axis.

(2-7) Auxiliary Bearing

The auxiliary bearing (22) is an auxiliary bearing support that rotatably supports the drive shaft (11). The auxiliary bearing (22) supports an end portion (a lower end portion in FIG. 2) of the drive shaft (11) on the opposite side from the compression mechanism (40). A bearing metal (23) is fitted to the inner surface of an upper portion of the auxiliary bearing (22). The auxiliary bearing (22) rotatably supports the main shaft portion (14) of the drive shaft (11) through the bearing metal (23). The auxiliary bearing (22) is housed in the casing (20). The auxiliary bearing (22) is located on the side of the electric motor (30) opposite to the housing (50). In this embodiment, the auxiliary bearing (22) is located below the electric motor (30).

The auxiliary bearing (22) is fixed to the inside of the casing (20). More specifically, the outer circumferential surface of the auxiliary bearing (22) is fixed to the inner circumferential surface of the barrel (20*a*). The auxiliary bearing (22) is welded to the barrel (20*a*) through a welding pin (81) and a joint (82). In this embodiment, the casing (20) and the auxiliary bearing (22) are not fixed to each other by fitting.

(2-8) Oil Supply Passage

An oil supply passage (16) is formed inside the drive shaft (11). The oil supply passage (16) extends vertically from the lower end to the upper end of the drive shaft (11). A pump (25) is connected to the lower end of the drive shaft (11). The pump (25) is a positive-displacement pump, for example. A lower end portion of the pump (25) is immersed in the oil reservoir (21).

The pump (25) sucks up the lubricant from the oil reservoir (21) as the drive shaft (11) rotates, and transfers the lubricant to the oil supply passage (16). The oil supply passage (16) supplies the lubricant in the oil reservoir (21) to the sliding surfaces between the auxiliary bearing (22) and the drive shaft (11) and the sliding surfaces between the upper bearing (51) and the drive shaft (11), and to the sliding surfaces between the boss (73) and the drive shaft (11). The oil supply passage (16) is open to the upper end surface of the drive shaft (11) and supplies the lubricant to above the drive shaft (11).

(3) Operation of Compressor

An operation of the scroll compressor (10) will be described below.

(3-1) Flow of Refrigerant

In FIG. 2, when the electric motor (30) is activated, the drive shaft (11) is driven to rotate. The orbiting scroll (70) makes an orbiting motion as the drive shaft (11) rotates. Since the Oldham coupling (45) blocks the rotation of the orbiting scroll (70) on its own axis, the orbiting scroll (70) rotates eccentrically about the axis of the drive shaft (11).

Due to the orbiting motion of the orbiting scroll (70), the refrigerant that has flowed into the suction port (64) through the suction pipe (12) is compressed in the fluid chamber (S). The high-pressure gas refrigerant compressed in the fluid chamber(S) is discharged from the outlet (65), and flows out into the lower space (24) via the discharge path (56) formed in the housing (50). The high-pressure gas refrigerant in the lower space (24) is discharged outside the casing (20) via the discharge pipe (13).

(3-2) Flow of Lubricant

The rotation of the drive shaft (11) causes the high-pressure lubricant in the oil reservoir (21) to be sucked up by the pump (25). The lubricant sucked up flows upward through the oil supply passage (16) of the drive shaft (11) and flows out from the opening at the upper end of the eccentric portion (15) of the drive shaft (11) into the inside of the boss (73) of the orbiting scroll (70).

The lubricant supplied to the boss (73) flows out into the recess (53) of the housing (50) through the gap between the eccentric portion (15) of the drive shaft (11) and the boss (73).

The lubricant accumulated in the recess (53) is supplied to the sliding surfaces between the fixed scroll (60) and the orbiting scroll (70) through an oil path (not shown) formed in the housing (50) and the fixed scroll (60), and is then returned to the oil reservoir (21).

(4) Fixing Structure of Housing

A fixing structure of the housing (50) will be described. In this embodiment, the housing (50) corresponds to a fixation target member (F) of the present disclosure. The fixation target member (F) is housed in the casing (20) and fixed to the barrel (20*a*) of the casing (20).

As illustrated in FIG. 3, the housing (50) has a contact region (A) in contact with the inner circumferential surface of the barrel (20*a*) of the casing (20). The contact region (A) forms part of the outer circumferential surface of the annular portion (52) of the housing (50). The contact region (A) of the housing (50) is a region of the outer circumferential surface of the annular portion (52) except the cutout (55). The contact region (A) of the housing (50) forms an arc shape when viewed in the axial direction. In other words, the housing (50) of this embodiment has one contact region (A). The housing (50) is fixed to the casing (20) by welding and fitting at the contact region (A).

(4-1) Weld

As illustrated in FIGS. 2 and 3, the scroll compressor (10) has a plurality of (four in this embodiment) welds (80) connecting the barrel (20*a*) and the housing (50). At the welds (80), the barrel (20*a*) and the housing (50) are fixed to each other through the welding pins (81) and the joints (82). Each of the welds (80) is formed by press-fitting the welding pin (81) into a hole formed in the housing (50), with the housing (50) fixed to the casing (20), and welding the welding pin (81) and the barrel (20*a*). The joint (82) is a portion formed by the welding pin (81) and the barrel (20*a*) melted by the welding.

As illustrated in FIG. 3, the welds (80) are arranged at predetermined intervals along the circumferential direction of the barrel (20*a*). In other words, the four welds (80) are provided in the one contact region (A) along the circumferential direction. Since the scroll compressor (10) has the plurality of welds (80) along the circumferential direction, it is possible to reduce relative misalignment of the housing (50) with the casing (20).

(4-2) Fit Relationship

The outer diameter of the annular portion (52) of the housing (50) and the inner diameter of the barrel (20*a*) of the casing (20) are in a fit relationship; therefore, the housing (50) is held by the casing (20).

Here, in the scroll compressor (10) of this embodiment, the fit relationship between the outer diameter of the housing (50) and the inner diameter of the casing (20) differs between an assembled state and a rated operating state of the scroll compressor (10). The fit relationship between the outer diameter of the housing (50) and the inner diameter of the casing (20) in each of the assembled state and the rated operating state of the scroll compressor (10) will be described in detail with reference to FIGS. 4 and 5.

The "assembled state" as used herein refers to a state in which the scroll compressor (10) is not connected to the refrigerant circuit (1*a*) and the pressure in the casing (20) is equal to the atmospheric pressure. The "rated operating state" as used herein refers to a state in which the scroll compressor (10) is connected to the refrigerant circuit (1*a*) and the scroll compressor (10) is operated under rated conditions.

The rated conditions as used herein mean the rated conditions defined in ISO 5151 and JIS B 8615. The high pressure in the casing (20) under the rated conditions differs depending on the type of the refrigerant that fills the refrigerant circuit (1*a*). For example, in the case of the refrigerant R32, the high pressure under the rated conditions is equal to or higher than 2.7 MPaG and equal to or lower than 3.4 MPaG. In the case of the refrigerant R410A, the high pressure under the rated conditions is equal to or higher than 2.6 MPaG and equal to or lower than 3.3 MPaG.

The dimensional tolerance of a shaft and a hole in a fit relationship with respect to the basic size of the shaft and the hole differs among fit relationships. The basic size as used herein refers to the nominal size in ISO 286-1:2010. In this embodiment, the basic size φ of each of the outer diameter of the annular portion (52) and the inner diameter of the barrel (20*a*) is 145 mm. The refrigerant filling the refrigerant circuit (1*a*) of this embodiment is R32, and the thickness of the casing (20) is 4.4 mm.

Figure 4:
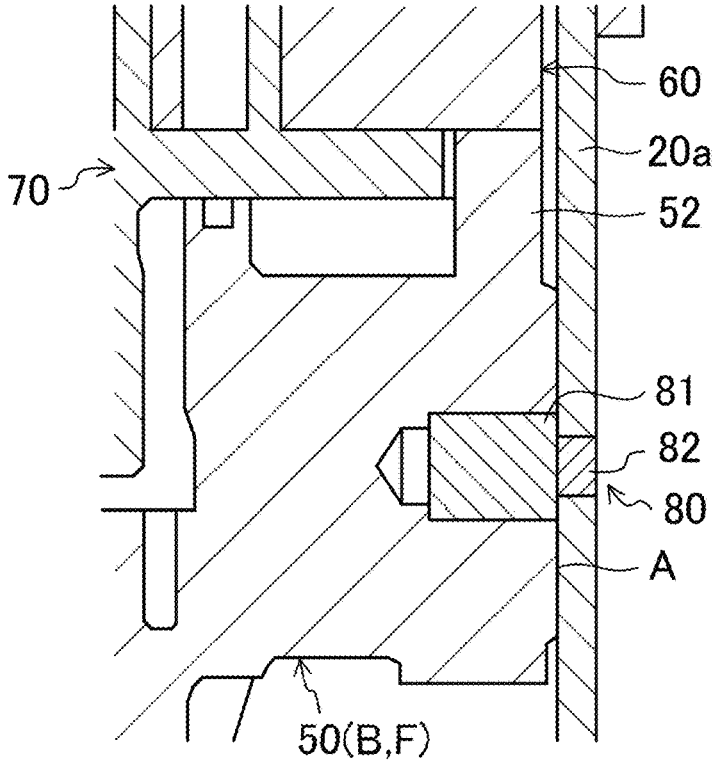
FIG. 4 is an enlarged view of a contact region of the scroll compressor in an assembled state and its surrounding area.

FIG. 4 is an enlarged view of the contact region (A) and its surrounding area of the scroll compressor (10) in the assembled state. As illustrated in FIG. 4, the inner circumferential surface of the barrel (20*a*) and the outer circumferential surface of the annular portion (52) are in contact with each other without a gap when the scroll compressor (10) is in the assembled state.

The inner diameter of the barrel (20*a*) and the outer diameter of the annular portion (52) in the assembled state of the scroll compressor (10) of this embodiment are in a relationship in which a combination of the tolerance class for the hole and the tolerance class for the shaft (hole/shaft) defined in ISO 286-1:2010 (hereinafter referred to as "ISO 286") corresponds to H7/n6. In other words, in the assembled state, the tolerance class of the inner diameter of the barrel (20*a*) corresponds to the tolerance class H7 for the hole defined in ISO 286, and the tolerance class of the outer diameter of the annular portion (52) corresponds to the tolerance class n6 for the shaft defined in ISO 286.

The above fit relationship is a fit relationship indicated as so-called "locational transition fit-interference." This fit relationship is a relationship in which the components cannot be moved relative to each other.

In this embodiment, the dimensional tolerance range in the assembled state of the scroll compressor (10) (specifically, a state in which the pressure in the casing (20) is equal to the atmospheric pressure) is 14 μm or more and 43 μm or less (14 μm to 43 μm) relative to the basic size. Specifically, the minimum permissible dimension in the assembled state of this embodiment is 145.014 mm, and the maximum permissible dimension is 145.043 mm. This fit relationship corresponds to so-called "interference fit."

Figure 5:
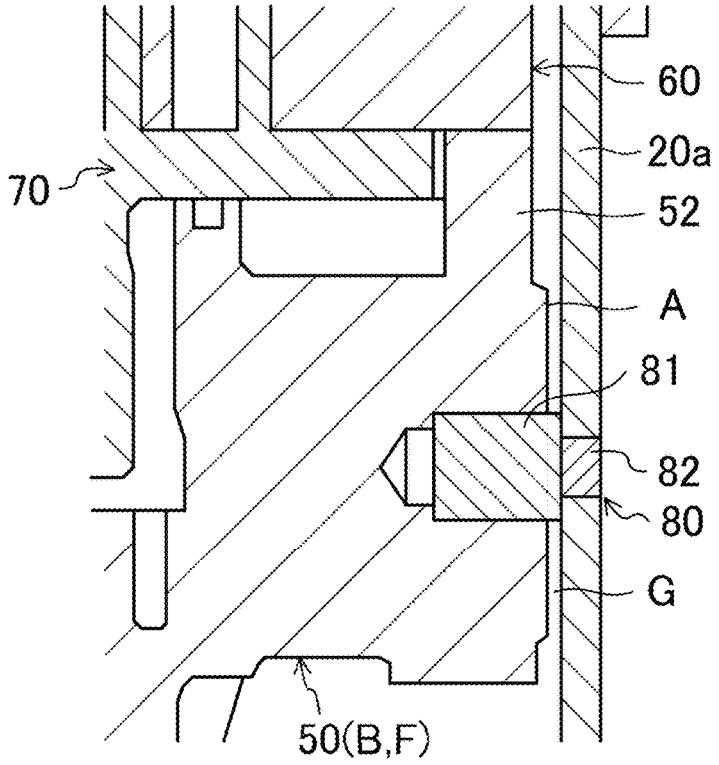
FIG. 5 is a diagram illustrating the scroll compressor in a rated operating state and corresponds to FIG. 4.

FIG. 5 is an enlarged view of the contact region (A) and its surrounding area of the scroll compressor (10) in the rated operating state. As illustrated in FIG. 5, there is a small gap between the inner circumferential surface of the barrel (20*a*) and the outer circumferential surface of the annular portion (52) in the rated operating state of the scroll compressor (10).

When the scroll compressor (10) starts to operate, the gas refrigerant sucked into the casing (20) is compressed in the compression mechanism (40). The compressed gas refrigerant is discharged into the casing (20), and the pressure in the casing (20) increases accordingly. The increase in pressure in the casing (20) leads to expansion of the casing (20). The small gap is therefore formed between the inner circumferential surface of the barrel (20*a*) and the outer circumferential surface of the annular portion (52).

Although in FIG. 5, the inner circumferential surface of the barrel (20*a*) and the outer circumferential surface of the annular portion (52) are not in contact with each other for easy understanding of the drawing, a local gap (G) is formed in practice between the inner circumferential surface of the barrel (20*a*) and the outer circumferential surface of the annular portion (52). In other words, there are a portion where the inner circumferential surface of the barrel (20*a*) and the outer circumferential surface of the annular portion (52) are in contact with each other, and a portion where they are not in contact with each other and a small gap (G) is formed. Such a local gap (G) is formed between the inner circumferential surface of the barrel (20*a*) and the outer circumferential surface of the annular portion (52) because, strictly speaking, the inside shape of the barrel (20*a*) and the outside shape of the annular portion (52) are a non-perfect circular shape when viewed in the axial direction, or because the inner circumferential surface of the barrel (20*a*) may be slightly inclined in the axial direction, or other reasons.

The inner diameter of the barrel (20*a*) and the outer diameter of the annular portion (52) in the rated operating state of the scroll compressor (10) of this embodiment are in a relationship in which a combination of the tolerance class for the hole and the tolerance class for the shaft (hole/shaft) defined in ISO 286 corresponds to H7/g6. In other words, in the rated operating state, the tolerance class of the inner diameter of the barrel (20*a*) corresponds to the tolerance class H7 for the hole defined in ISO 286, and the tolerance class of the outer diameter of the annular portion (52) corresponds to the tolerance class g6 for the shaft defined in ISO 286.

The fit relationship is a fit relationship indicated as so-called "sliding fit-constrained." This fit relationship is a relationship in which the components can be moved relative to each other.

The dimensional tolerance range in the rated operating state of the scroll compressor (10) of this embodiment (specifically, a state in which the pressure in the casing (20) is 2.5 MPa) is −43 μm or more and 14 μm or less (−43 μm to 14 μm) relative to the basic size. Specifically, the minimum permissible dimension in the rated operating state in this embodiment is 144.957 mm, and the maximum permissible dimension is 145.014 mm. This fit relationship corresponds to so-called "clearance fit." More specifically, this fit relationship corresponds to so-called "precise-fit."

As can be seen, the fit relationship between the inner diameter of the barrel (20*a*) and the outer diameter of the annular portion (52) changes due to a change in the state of the scroll compressor (10) from the assembled state to the rated operating state.

In the rated operating state of the scroll compressor (10), the local gap (G) is formed between the inner circumferential surface of the barrel (20*a*) and the outer circumferential surface of the annular portion (52) as described above, and a great misalignment between the casing (20) and the housing (50) is reduced by the plurality of welds (80) provided in the circumferential direction. Thus, the housing (50) can move slightly relative to the casing (20).

Accordingly, in a region where the gap (G) is formed between the inner circumferential surface of the barrel (20*a*) and the outer circumferential surface of the annular portion (52), the housing (50) vibrates in response to vibrations transferred to the housing (50) from the compression mechanism (40); thus, the vibration energy is converted into kinetic energy, which attenuates the vibrations transferred from the compression mechanism (40).

In addition, in a region where the inner circumferential surface of the barrel (20*a*) and the outer circumferential surface of the annular portion (52) are in contact with each other, the inner circumferential surface of the barrel (20*a*) and the outer circumferential surface of the annular portion (52) rub against each other; thus, the vibration energy is converted into thermal energy, which attenuates the vibrations transferred from the compression mechanism (40).

In the rated operating state of the scroll compressor (10), the local gap (G) is formed between the inner circumferential surface of the barrel (20*a*) and the outer circumferential surface of the annular portion (52) as described above, which allows the housing (50) to move slightly. It is thus possible to attenuate the vibrations generated by the compression mechanism (40) effectively. As a result, it is possible to reduce noise generated in the scroll compressor (10).

The basic size, the dimensional tolerance range, the type of the refrigerant, and the thickness of the casing in this embodiment are merely examples. The degree of expansion of the casing (20) in the rated operating state of the scroll compressor (10) differs depending on the type of the refrigerant filling the refrigerant circuit (1*a*), the thickness of the casing (20), and other factors.

Here, FIG. 6 shows the terms indicating the fit relationships, the tolerance classes defined in ISO 286 which correspond to the fit relationships, and the dimensional tolerance ranges corresponding to the respective tolerance classes at a basic size of φ145 mm.

As shown in FIG. 6, the inner diameter of the barrel (20*a*) and the outer diameter of the annular portion (52) in the assembled state of the scroll compressor (10) of this embodiment may be in a fit relationship in which a combination of the tolerance class for the hole and the tolerance class for the shaft (hole/shaft) defined in ISO 286 corresponds to H7/r6, H7/s6, or H8/u8.

The fit relationship are fit relationships indicated as so-called "locational interference fit," "medium drive fit," or "force fit." These fit relationships are relationships in which the components cannot be moved relative to each other. The fit relationships correspond to so-called "interference fit."

As shown in FIG. 6, the inner diameter of the barrel (20*a*) and the outer diameter of the annular portion (52) in the rated operating state of the scroll compressor (10) of this embodiment may be in a fit relationship in which a combination of the tolerance class for the hole and the tolerance class for the shaft (hole/shaft) defined in ISO 286 corresponds to H8/f7, F8/h9, H7/f7, F8/h6, or G7/h6.

The fit relationships are fit relationships indicated as so-called "close running fit," "sliding fit-free," or "sliding fit-constrained." These fit relationships are relationships in which the components can be moved relative to each other. These fit relationships correspond to so-called "clearance fit."

Even if the inner diameter of the barrel (20*a*) and the outer diameter of the annular portion (52) in the rated operating state of the scroll compressor (10) are in the above-mentioned fit relationship defined in ISO 286, a local gap (G) is formed between the inner circumferential surface of the barrel (20*a*) and the outer circumferential surface of the annular portion (52), similarly to the case in which a combination of the tolerance class for the hole and the tolerance class for the shift (hole/shaft) defined in ISO 286 is H7/g6.

Accordingly, the energy of vibrations propagated to the housing (50) from the compression mechanism (40) as the scroll compressor (10) operates is converted into kinetic energy generated by the movement of the housing (50) or thermal energy generated by friction between the housing (50) and the casing (20), which attenuates the vibrations propagated from the compression mechanism (40). As a result, it is possible to reduce noise generated in the scroll compressor (10).

(5) Features (5-1) Feature 1

The inner diameter of the barrel (20*a*) of the casing (20) and the outer diameter of the annular portion (52) of the housing (50) in the rated operating state of the scroll compressor (10) are in a fit relationship in which a combination of the tolerance class for the hole and the tolerance class for the shaft (hole/shaft) defined in ISO 286 corresponds to H8/f7, F8/h9, H7/f7, F8/h6, H7/g6, or G7/h6.

In the rated operating state of the scroll compressor (10), the barrel (20*a*) expands as the pressure of the refrigerant in the casing (20) increases, which causes the inner diameter of the barrel (20*a*) and the outer diameter of the annular portion (52) to be in the fit relationship defined in ISO 286. In this fit relationship, the local gap (G) is formed between the inner circumferential surface of the barrel (20*a*) and the outer circumferential surface of the annular portion (52). At this moment, the housing (50) can move slightly relative to the casing (20). Accordingly, the energy of vibrations propagated to the housing (50) from the compression mechanism (40) as the scroll compressor (10) operates is converted into kinetic energy generated by the movement of the housing (50) or thermal energy generated by friction between the housing (50) and the casing (20), which attenuates the vibrations propagated from the compression mechanism (40). As a result, it is possible to reduce noise generated in the scroll compressor (10).

(5-2) Feature 2

The inner diameter of the barrel (20*a*) and the outer diameter of the annular portion (52) in the assembled state of the scroll compressor (10) are in a fit relationship in which a combination of the tolerance class for the hole and the tolerance class for the shaft (hole/shaft) defined in ISO 286 corresponds to H7/n6, H7/r6, H7/s6, or H8/u8.

Since the inner diameter of the barrel (20*a*) and the outer diameter of the annular portion (52) in the assembled state of the scroll compressor (10) are in the above-described fit relationship defined in ISO 286, the annular portion (52) of the housing (50) is fixed to the barrel (20*a*) by the welds (80) and by fitting.

Misalignment of the housing (50) in forming the welds (80) is reduced by forming the welds (80) after having the annular portion (52) of the housing (50) held on the barrel (20*a*) in the fit relationship defined in ISO 286. This improves the ease of assembly.

(5-3) Feature 3

The fixation target member (F) is the housing (50) of the scroll compressor (10). Since the housing (50) supports the compression mechanism (40), vibrations of the compression mechanism (40) are easily transferred to the housing (50). It is possible to further reduce noise of the compressor by applying the fit relationship defined in ISO 286 to the inner diameter of the barrel (20*a*) and the outer diameter of the housing (50).

(5-4) Feature 4

At the welds (80), the barrel (20*a*) of the casing (20) and the annular portion (52) of the housing (50) are welded to each other through the welding pins (81).

(5-5) Feature 5

The refrigeration apparatus (1) includes the scroll compressor (10) of this embodiment and the refrigerant circuit (1*a*) through which the refrigerant compressed by the scroll compressor (10) flows. It is thus possible to provide a refrigeration apparatus (1) with reduced noise of the scroll compressor (10).

(6) Variations

The above embodiment may be modified as the following variations. In the following description, differences from the embodiment will be described in principle.

(6-1) First Variation

In the scroll compressor (10) of this embodiment, the fixation target member (F) may be an auxiliary bearing (22). The auxiliary bearing (22) corresponds to a support (B) of the present disclosure. The auxiliary bearing (22) is connected to the compression mechanism (40) through the drive shaft (11). Thus, vibrations generated in the compression mechanism (40) propagate to the auxiliary bearing (22) through the drive shaft (11).

Figure 7:
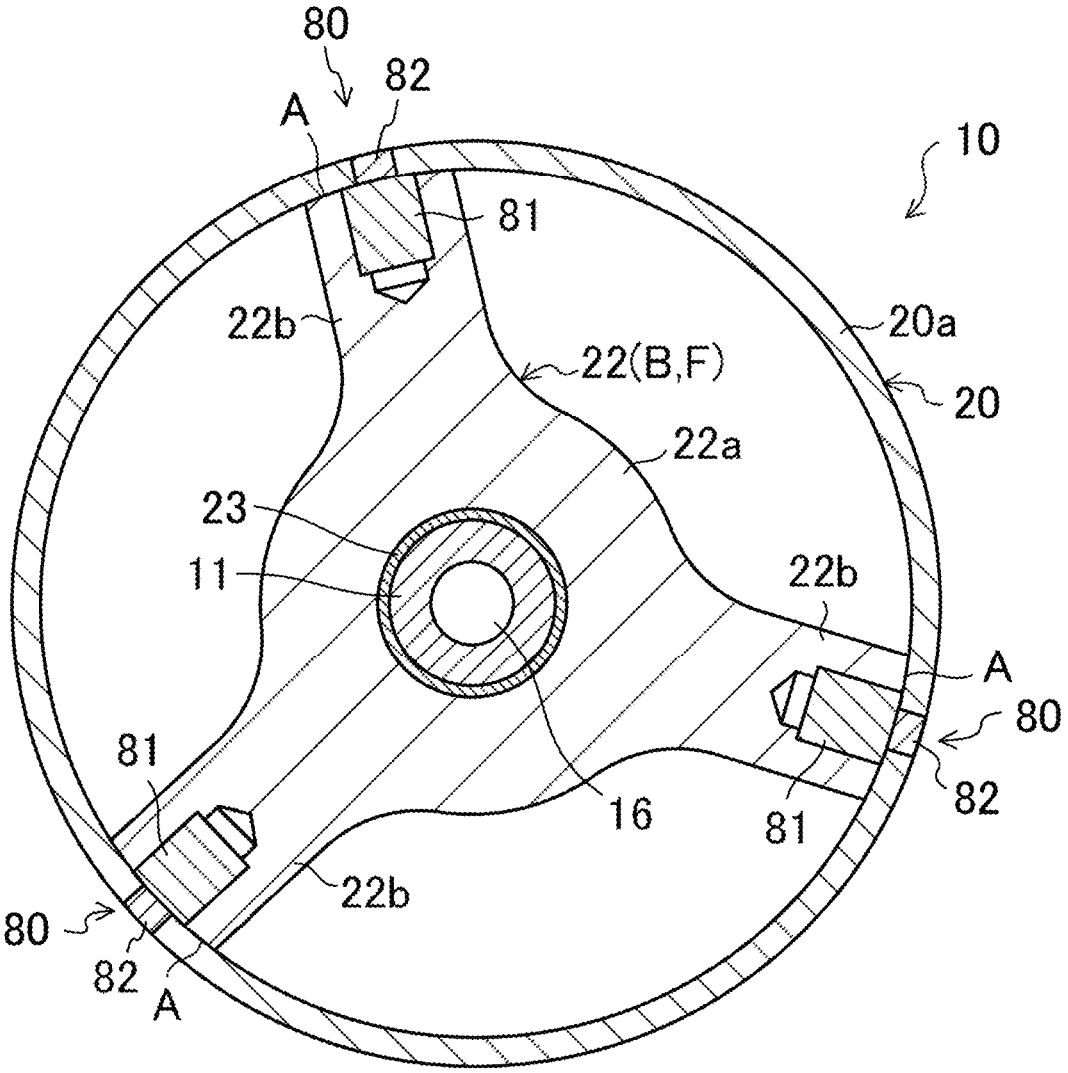
FIG. 7 is a horizontal sectional view illustrating an auxiliary bearing of a first variation.

Here, the auxiliary bearing (22) crosses the casing (20) as illustrated in FIG. 7. The auxiliary bearing (22) includes a ring-shaped ring portion (22*a*) forming a central portion and three protrusions (22*b*) protruding radially outward from the ring portion. The drive shaft (11) is inserted in the center of the ring portion (22*a*). The three protrusions (22*b*) are arranged at predetermined intervals in the circumferential direction.

The auxiliary bearing (22) has a plurality of (three in this variation) contact regions (A) in contact with the inner circumferential surface of the barrel (20*a*) of the casing (20). The contact regions (A) of the auxiliary bearing (22) form the outer circumferential surfaces of the protrusions (22*b*). Each of the contact regions (A) of the auxiliary bearing (22) has an arc shape when viewed in the axial direction.

In this variation, the auxiliary bearing (22) is fixed to the casing (20) by welding and fitting at the contact regions (A) in the operation stop state of the scroll compressor (10). In this variation, the three welds (80) are arranged at predetermined intervals along the circumferential direction of the barrel (20*a*). Each of the three welds (80) is provided for the associated contact region (A). In other words, one weld (80) is provided for one contact region (A). Since the scroll compressor (10) has the plurality of welds (80) along the circumferential direction, it is possible to reduce relative misalignment of the auxiliary bearing (22) with the casing (20).

In this variation, the inner diameter of the barrel (20*a*) and the outer diameter of the annular portion (52) in the assembled state of the scroll compressor (10) are in a fit relationship in which a combination of the tolerance class for the hole and the tolerance class for the shaft (hole/shaft) defined in ISO 286 corresponds to H7/n6, H7/r6, H7/s6, or H8/u8.

In this variation, the inner diameter of the barrel (20*a*) and the outer diameter of the annular portion (52) in the rated operating state of the scroll compressor (10) are in a fit relationship in which a combination of the tolerance class for the hole and the tolerance class for the shaft (hole/shaft) defined in ISO 286 corresponds to H8/f7, F8/h9, H7/f7, F8/h6, H7/g6, or G7/h6.

Accordingly, a local gap (G) is formed between the inner circumferential surface of the barrel (20*a*) of the casing (20) and the outer circumferential surface of each of the protrusions (22*b*) of the auxiliary bearing (22) also when the fixation target member (F) is the auxiliary bearing (22). It is thus possible to provide effects and advantages similar to those of the foregoing embodiment.

OTHER EMBODIMENTS

The above-described embodiment may be modified as follows.

The compressor (10) of the foregoing embodiment may be a rotary compressor. In this case, the fixation target member (F) may be a front head, a cylinder, or a rear head. The cylinder is a member forming a compression mechanism, and forms a fluid chamber together with a piston. The front head and the rear head are bearing supports that rotatably support a drive shaft. The front head or the rear head corresponds to a support (B) of the present disclosure. The cylinder, the front head, and the rear head are cylindrical. The outer circumferential surfaces of the cylinder, the front head, and the rear head are fixed to the inner circumferential surface of a casing.

If the compressor (10) of the foregoing embodiment is a rotary compressor, the support (B) may be a mounting plate that supports the front head body on the casing. The mounting plate is a component of the front head. If the front head includes the mounting plate, the front head is fixed to the casing through the mounting plate. The mounting plate is, for example, a plate-shaped member which extends along the inner circumference of the casing throughout the entire circumference, and the vertical cross section of which has a substantially L shape.

While the embodiment and variations thereof have been described above, it will be understood that various changes in form and details may be made without departing from the spirit and scope of the claims. The elements according to embodiments, the variations thereof, and the other embodiments may be combined and replaced with each other.

The ordinal numbers such as "first," "second," "third," . . . , described above are used to distinguish the terms to which these expressions are given, and do not limit the number and order of the terms.

As described above, the present disclosure is useful for a compressor and a refrigeration apparatus.

The invention claimed is:

1. A compressor comprising:

a casing having a tubular barrel;

a fixation target member housed in the casing and fixed to the barrel; and a plurality of welds provided in a circumferential direction of the barrel, the welds connecting the barrel and the fixation target member to each other, the fixation target member being a compression mechanism configured to compress a refrigerant or a support configured to rotatable support a drive shaft connected to the compression mechanism, a fit relationship between an inner diameter of the barrel and an outer diameter of the fixation target member being such that, in an assembled state of the compressor, a combination of a tolerance class for a hole and a tolerance class for a shaft (hole/shaft) for the fit, as defined in ISO 286, corresponds to H7/n6, H7/r6, H7/s6, or H8/u8, and in a rated operating state of the compressor, the combination of the tolerance class for the hole and the tolerance class for the shaft (hole/shaft) for the fit, as defined in ISO 286, corresponds to H8/f7, F8/h9, H7/f7, F8/h6, H7/g6, or G7/h6.

2. The compressor of claim 1, further comprising:

a main bearing housing as the support, the main bearing housing being configured to support the compression mechanism, the compression mechanism including a fixed scroll and an orbiting scroll configured to mesh with the fixed scroll, and the fixation target member being the main bearing housing.

3. The compressor of claim 1, further comprising:

a main bearing housing as the support, the main bearing housing being configured to support the compression mechanism, the compression mechanism including a fixed scroll and an orbiting scroll configured to mesh with the fixed scroll, and the fixation target member being the main bearing housing.

4. The compressor of claim 1, wherein at the welds, the barrel and the fixation target member are welded to each other through pins.

5. A refrigeration apparatus including the compressor of claim 1, the refrigeration apparatus further comprising:

a refrigerant circuit through which a refrigerant compressed by the compressor flows.

* * * * *